United States Patent [19]

Hayes, Jr.

[11] 4,456,370

[45] Jun. 26, 1984

[54] CHARGE CONTROL SYSTEM

[75] Inventor: Thomas A. Hayes, Jr., Leroy, N.Y.

[73] Assignee: Xerox Corporation, Stamford, Conn.

[21] Appl. No.: 439,686

[22] Filed: Nov. 8, 1982

[51] Int. Cl.[3] ..... G03G 15/00

[52] U.S. Cl. ..... 355/14 CH; 355/3 CH

[58] Field of Search ..... 355/14 CH, 14 R, 3 CH; 361/230, 235; 250/324–326

[56] References Cited

U.S. PATENT DOCUMENTS 4,141,648 2/1979 Gaitten et al. ..... 355/14 CH 4,234,249 11/1980 Weikel ..... 355/3 CH 4,268,161 5/1981 Nakahata et al. ..... 355/3 CH

*Primary Examiner*—R. L. Moses

*Attorney, Agent, or Firm*—H. Fleischer; J. E. Beck; R. Zibelli

[57] ABSTRACT

An apparatus which controls the electrical charging of a photoconductive member used in an electrophotographic printing machine. The apparatus has a pair of corona generating devices. The second corona generating device detects the level of charge on the photoconductive surface after the charging thereof by the first corona generating device. In response to the detected charge level, the second corona generating device transmits a control signal to the first corona generating device so as to regulate the charge on the photoconductive member.

12 Claims, 2 Drawing Figures

CHARGE CONTROL SYSTEM

Figure 1:
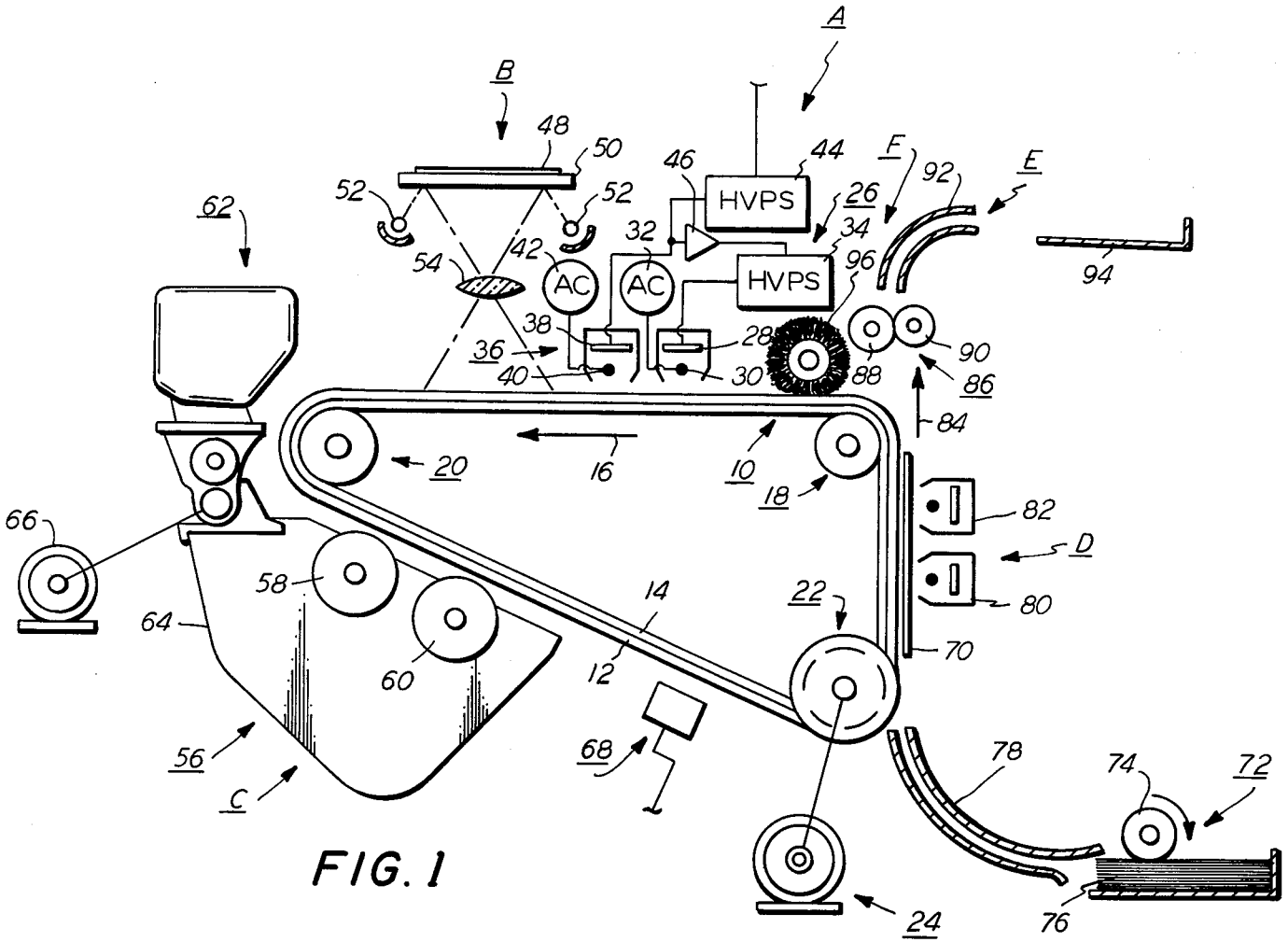

This invention relates generally to an electrophotographic printing machine, and more particularly concerns an apparatus for controlling the charging of a photoconductive member used therein.

Generally, the process of electrophotographic printing includes charging the photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer mixture into contact therewith. This forms a powder image on the photoconductive member which is subsequently transferred to a copy sheet. Finally, the powder image is heated to permanently affix it to the copy sheet in image configuration.

In an electrophotographic printing machine, the overall control object is to maintain the output density of the copy substantially constant relative to the input density of the original document. The charge level on the photoconductive surface is critical to the production of good quality copies. Hereinbefore, electrophotographic printing machines have included control loops for regulating the charging of the photoconductive surface. The charge control loop employed an electrometer positioned adjacent the photoconductive surface. The electrometer transmitted a signal proportional to the potential of the photoconductive surface. This signal was conveyed to a controller which regulated a high voltage power supply energizing a corona generating device charging the photoconductive surface. Regulation of the power supply controlled charging of the photoconductive surface.

Image contrast is related directly to the potential charge on the photoconductive surface prior to exposure. If the photoconductive surface is not uniformly charged over the entire area, the contrast value of the electrostatic latent image obtained upon exposure will vary in different areas and a streaky effect will be visible in the developed image. Various systems have been devised for regulating the charging of the photoconductive surface. The following disclosures appear to be relevant:

U.S. Pat. No. 3,805,069
Patentee: Fisher
Issued: Apr. 16, 1974

Xerox Disclosure Journal
Author: Hudson
Volume I, No. 2
February 1976, page 67

Xerox Disclosure Journal
Author: Springett
Volume IV, No. 5
September/October 1979, Page 607

U.S. Pat. No. 4,318,610
Patentee: Grace
Issued: Mar. 9, 1982

Co-pending Application Ser. No. 412,683
Applicant: Shenoy
Filed: Aug. 30, 1982

The relevant portions of the foregoing disclosures may be briefly summarized as follows:

Fisher discloses a closed loop system for controlling the power supply regulating the charging of a corona generating device in response to temperature variations on the photoconductive surface.

Hudson describes a system wherein the charge on the photoconductive surface is compared to a reference potential with the error signal being used to control charging by the corona generating device.

Springett shows, in a set of equations, that the dynamic current of a first corona generator may be used as a feed-back signal to hold the dynamic current of a second corona generator at the required level to maintain the outgoing photoreceptor potential constant.

Grace describes a system for detecting the density of toner particles developed on a sample patch recorded on a photoconductive surface. An electrical output signal is generated indicative of the sensed density of toner particles and used to control the power supply energizing the corona generating device.

Shenoy discloses a system which utilizes the shield voltage to derive signals which may be employed for maintaining the charge on the photoconductive surface at a predetermined level. The shield voltage is measured in a conducting and nonconducting state. The difference between these two voltages is compared to a reference voltage to generate an output signal which controls the voltage applied to either the shield or coronode of the corona generating device.

In accordance with one aspect of the present invention, there is provided an apparatus for controlling the charging of a photoconductive surface. First corona generating means charges a portion of the photoconductive surface to a substantially uniform level. Second corona generating means further charges the portion of the first photoconductive surface charged by the first corona generating means. The second corona generating means detects the level of charge on the portion of the photoconductive surface charged by the first corona generating means and transmits a control signal to the first corona generating means to regulate the level that the first corona generating means charges the photoconductive surface.

Pursuant to another aspect of the present invention, there is provided on electrophotographic printing machine of the type in which the charging of a photoconductive surface is controlled. The improved printing machine includes a first corona generating means for charging a portion of the photoconductive surface to a substantially uniform level. Second corona generating means further charges the portion of the photoconductive surface charged by the first corona generating means. The second corona generating means detects the level of charge on the portion of the photoconductive surface charged by the first corona generating means and transmits a control signal to the first corona generating means to regulate the level that the first corona generating means charges the photoconductive surface.

Figure 2:
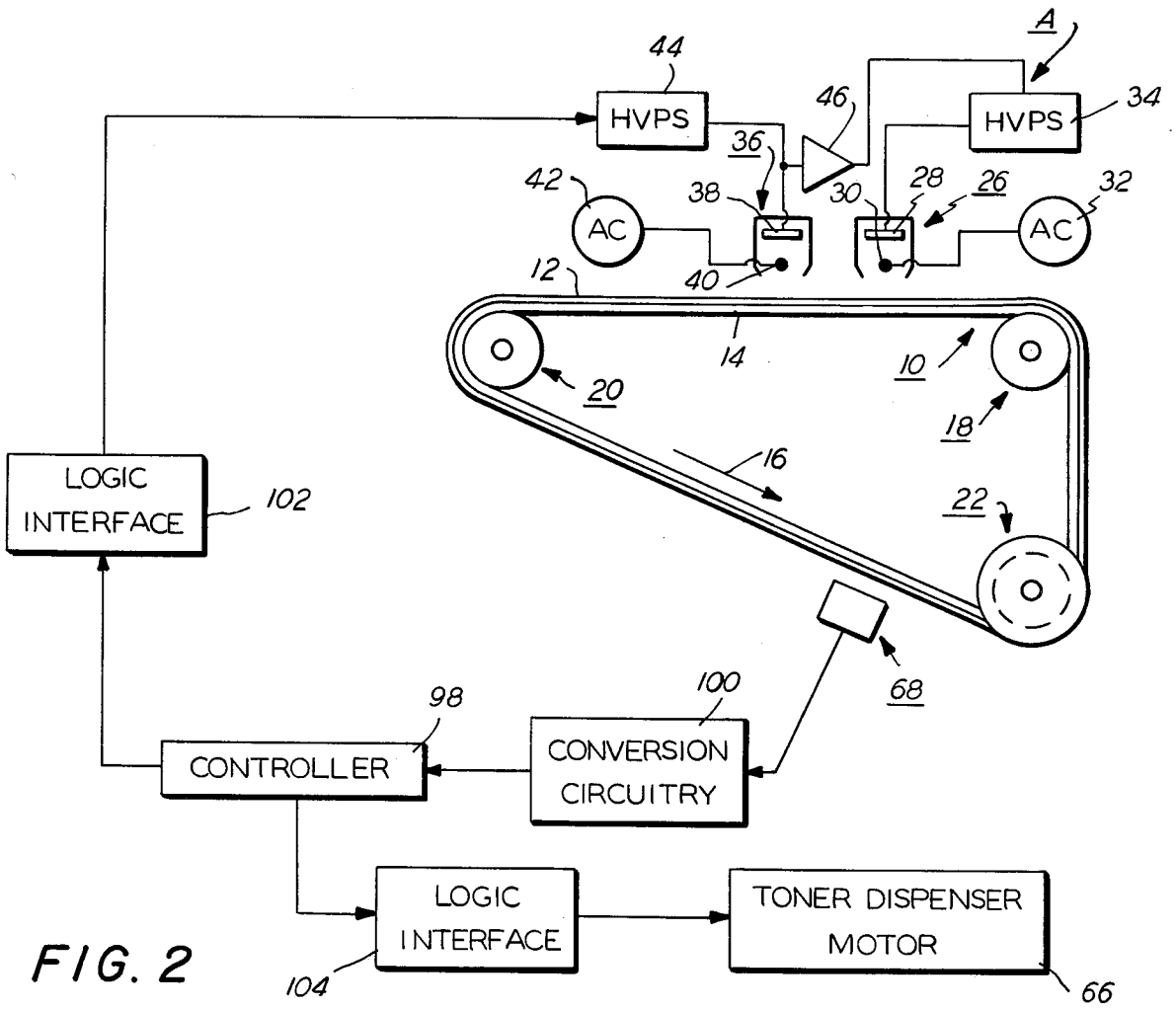

Other aspects of the present invention will become apparent as the following description proceeds and upon reference to the drawings, in which:

FIG. 1 is a schematic elevational view showing an electrophotographic printing machine incorporating the features of the present invention therein; and FIG. 2 is a block diagram depicting the control loop employed in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawing, like reference numerals have been used throughout to designate identical elements. FIG. 1 schematically depicts the various components of an illustrative electrophotographic printing machine incorporating the charge control system of the present invention therein. It will become apparent from the following discussion that this charge control system is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

The charge control scheme of the present invention utilizes a pair of corona generating devices for charging the photoconductive surface. The first corona generating device, in the direction of movement of the photoconductive member, charges a portion thereof. The second corona generating device detects the charge on the photoconductive member and adjust the level of charging by the first corona generating device to maintain the charge on the photoconductive member at an optimum value.

Turning now to FIG. 1, the illustrative electrophotographic printing machine employs a belt 10 having a photoconductive surface 12 deposited on a conductive substrate 14. Preferably, photoconductive surface 12 includes a charge generator layer having photoconductive particles randomly dispersed in an electrically insulating organic resin. Conductive substrate 14 comprises a charge transport layer having a transparent, electrically inactive polycarbonate resin with one or more diamines dissolved therein. A photoconductive belt of this type is disclosed in U.S. Pat. No. 4,265,990 issued to Stolka et al., in 1981, the relevant portions thereof being hereby incorporated into the present application. Belt 10 moves in the direction of arrow 16 to advance successive portions of photoconductive surface 12 sequentially through the various processing stations disposd about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive. Drive roller 22 includes a pair of opposed, spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

With continued reference to FIG. 1, initially a portion of belt 10 passes through charging station A. At charging station A, a corona generating device indicated generally by the reference numeral 26, charges photoconductive surface 12 to a relatively high, substantially uniform potential. Corona generating device 26 has a conductive shield 28 and a dicorotron electrode 30. Electrode 30 is made preferably from an elongated bare wire having a relatively thick electrically insulating layer thereon. The insulating layer is of a thickness which precludes a net DC corona current when an AC voltage is applied to the wire with the shield and photoconductive surface being at the same potential. In the absence of an external field supplied by either a bias supply to the shield or a charge on the photoconductive surface, there is substantially no net DC current flow. Electrode 30 is connected to a high voltage alternating current power supply 32 which produces approximately 6,000 volts AC sine wave. A corona is produced about electrode 30 causing a conductive ion plasma of gas. The gas plasma acts as a resistance path between photoconductive surface 12 and shield 28. When charging photoconductive surface 12, shield 28 is electrically biased to a negative voltage potential causing a current to flow between the shield and photoconductive surface. High voltage power supply 34 is coupled to shield 28. A change in output of power supply 34 causes corona generating device 26 to vary the charge voltage applied to photoconductive surface 12. A second corona device, indicated generally by the reference numeral 36, also includes a conductive shield 38 and a dicorotron electrode 40. Electrode 40 has an elongated bare wire with a relatively thick electrically insulating layer thereon. The electrical insulating layer is of a thickness which precludes a net DC corona current when an AC voltage is applied to the electrode with the shield and photoconductive surface being at the same potential. Electrode 40 is electrically connected to high voltage AC power supply 42. Similarly, power supply 42 excites electrode 40 at about 6,000 voltage AC sine wave. High voltage power supply 44 is electrically connected to shield 38. Corona generating device 36 measures the voltage or charge on the photoconductive surface 12. The potential on the photoconductive surface must be at approximately the same voltage as the voltage on shield 38. The difference in voltage is measured by a feedback circuit. This voltage difference is used to control power supply 34 to regulate the charging of corona generating device 26. A feedback amplifier 46 is electrically coupled to power supply 34 and shield 38. The shield current is amplified by amplifier 46 and transmitted to power supply 34. Power supply 44 electrically biases shield 38. Hence, the shield current corresponds to the difference in potential between the potential on the photoconductive surface and that of the potential on shield 38. The current flowing from shield 38 is fed back through amplifier 46 to power supply 34 to adjust the voltage on shield 28 and, thereby to adjust the charging of photoconductive surface 12. Power supply 44, in turn, has its voltage output controlled by the processing electronics of the printing machine. The foregoing will be further amplified with reference to FIG. 2.

With continued reference to FIG. 1, the charged portion of photoconductive surface 12 is advanced through exposure station B. At exposure station B, an original document 48 is positioned facedown upon a transparent platen 50. Lamps 52 flash light rays onto original document 48. The light rays reflected from original document 48 are transmitted through lens 54 forming a light image thereof. Lens 54 focuses the light image onto the charged portion of photoconductive surface 12 to selectively dissipate the charge thereon. This records an elecrostatic latent image on photoconductive surface 12 which corresponds to the informational areas contained within original document 48. One skilled in the art will appreciate that alternative systems may be employed to selectively discharge the charged photoconductive surface to record a latent image thereon. For example, a modulated lighted beam, i.e. a laser beam, may be used. The laser beam is modulated by suitable logic circuitry to selectively discharge the charged portion of the photoconductive surface. In this way, information that is electronically generated may be recorded as an electrostatic latent image on the photoconductive surface. Exemplary systems of this type are electronic printing systems.

Exposure station B includes a test area generator which comprises a light source electronically programmed to two different output levels. In this way, two different intensity test light images are projected onto the charged portion of photoconductive surface 12 in the inter-image area to record two test areas thereon. The light output level from the test area generator is such that one of the test light images is exposed to greater intensity light than the other. These test light images are projected onto the charge portion of photoconductive surface 12 to form test areas. Both of these test areas are subsequently developed with toner particles. After the elecrostatic latent image has been recorded on photoconductive surface 12 and the test areas recorded in the inter-image areas, belt 10 advances the electrostatic latent image and the test areas to development station C.

At devlopment station C, a magnetic brush development system, indicated generally by the reference numeral 56, advances the developer material into contact with the electrostatic latent image and the test areas. Preferably, magnetic brush development system 56 includes two magnetic brush developer rollers 58 and 60. These rollers each advance developer material into contact with the latent image and test areas. Each developer roller forms a brush comprising carrier granules and toner particles. The latent image and test areas attract the toner particles from the carrier granules forming a toner powder image on the latent image and a pair of developed areas corresponding to each of the test areas. As successive latent images are developed, toner particles are depleted from the developer material. A toner particle dispenser, indicated generally by the reference numeral 62, is arranged to furnish additional toner particles to developer housing 64 for subsequent use by developer rollers 58 and 50, respectively. Toner dispenser 62 includes a container storing a supply of toner particles therein. A foam roller disposed in a sump coupled to the container dispenses toner particles into an auger. Motor 66 rotates the auger to advance the toner particles through a tube having a plurality of apertures therein. The toner particles are dispensed from the apertures in the tube into developer housing 64. The developed test areas pass beneath a collimated infrared densitometer, indicated generally by the reference numeral 68.

Infrared densitometer 68, positioned adjacent photoconductive surface 12 between development station C and transfer station D, generates electrical signals proportional to the developed toner mass of the test areas. These signals are conveyed to a controller which regulates high voltage power supply 44 and motor 66 so as to control charging of photoconductive surface 12 and dispensing of toner particles into the developer mixture. The detailed structure of infrared densitometer 68 and the control system associated therewith is disclosed in U.S. Pat. No. 4,318,610 issued to Grace in 1982, the relevant portions thereof being hereby incorporated into the present application.

A sheet of support material 70 is advanced into contact with the toner powder image at transfer station D. Support material 70 is advanced to transfer station D by sheet feeding apparatus 72. Preferably, sheet feeding apparatus 72 includes a feed roll 74 contacting the uppermost sheet of stack 76. Feed roll 74 rotates to advance the uppermost sheet from stack 76 into chute 78. Chute 78 directs the advancing sheet of support material into contact with photoconductive surface 12 of belt 10 in a timed sequence so that the toner powder image developed thereon contacts the advancing sheet of support material at transfer station D.

Transfer station D includes a corona generating device 80 which sprays negative ions onto the backside of sheet 70 so that toner powder images which comprise positive toner particles are attracted from photoconductive surface 12 of belt 10 to sheet 70. Subsequent to transfer, sheet 70 moves past a detack corona generating device 82. Corona generating device 82 at least partially neutralizes the charges placed on the backside of sheet 70. The partial neutralization of the charges on the backside of sheet 70 reduces the bonding force holding it to photoconductive surface 12 of belt 10. This enables the sheet to be stripped as the belt moves around the sharp bend of stripping roller 18. After detack, the sheet continues to move in the direction of arrow 84 onto a conveyor (not shown) which advances the sheet to fusing station E.

Fusing station E includes a fuser assembly indicated generally by the reference numeral 86, which permanently affixes the transferred powder image to sheet 70. Preferably, fuser assembly 86 comprises a heated fuser roller 88 and a back-up roller 90. Sheet 70 passes between fuser roller 88 and back-up roller 90 with the toner powder image contacting fuser roller 88. In this manner, the toner powder image is permanently affixed to sheet 70. Chute 92 guides the advancing sheet 70 to catch tray 94 for subsequent removal from the printing machine by the operator.

After the sheet of support material is separated from photoconductive surface 12 of belt 10, the residual toner particles adhering to photoconductive surface 12 are removed therefrom. These particles are cleaned from photoconductive surface 12 at cleaning station F. By way of example, cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Referring now to FIG. 2, the details of the control system are shown thereat. As illustrated, charging station A comprises a pair of corona generating devices indicated generally by the reference numerals 26 and 36, respectively. The structure of corona generating device 26 and corona generating device 36 are identical. The respective electrodes are supported at the ends thereof by insulating end blocks mounted within the ends of their respective shield structure. The electrode wire may be made from any conventional conductive filament material such as stainless steel, gold, aluminum, copper, tungsten, platinum or the like. The diameter of the wire is not critical and may vary typically between 0.5 and 15 mils and preferably ranges from about 3 to 6 mils. Any suitable dielectric material may be employed as the electrode wire coating as long as it will not breakdown under the applied corona AC voltage, and will withstand chemical attacks under the conditions present in a corona generating device. Inorganic dielectrics have been found to perform most satisfactorily due to their high voltage breakdown properties and greater resistance to chemical reaction in the corona environment. The thickness of the dielectric coating used in the device is such that when an AC voltage is applied to the wire and with the photoconductive surface and shield at the same potential, substantially no conductive current or DC charging current is permitted therethrough. Typically, the thickness is such that the combined wire and dielectric thickness falls in the range of from about 5 to about 30 mils with a typical dielectric thickness ranging from about 1 to about 10 mils. Glass, having a dielectric breakdown strength of about 5 kv/mm, performs satisfactorily as the dielectric coating material. The glass coating selected should be free of voids and inclusions, and make good contact with or wet the wire on which it is deposited. Other possible coatings are ceramic materials such as alumina, zirconia, boron, nitrite, berylium oxide and silica nitrite. Organic dielectrics which are suitably stable in corona may also be employed.

As illustrated in FIG. 2, the conductive shield 28 of corona generating device 26 is coupled to high voltage power supply 34. AC power supply 32 energizes electrode 30 at a high AC voltage. A corona is produced around the electrode causing a conductive ion plasma of gas. The gas plasma acts as a resistance path between photoconductive surface 12 and shield 28. Power supply 34 electrically biases shield 28 to a negative voltage potential causing a current to flow to photoconductive surface 12. This charges photoconductive surface 12 to a negative potential. Any variations in the charge on photoconductive surface 12 from the desired charge are then detected by corona generating device 36 and an error signal indicative thereof generated and fed back to power supply 34 so as to adjust the charge produced by corona generating device 26. More particularly, electrode 40 of corona generating device 36 is coupled to high voltage AC power supply 42 to also produce a corona causing a conductive ion plasma of gas. Power supply 44 electrically biases shield 38 to a preselected voltage potential. When there is a difference in potential between shield 38 and photoconductive surface 12, current flows therebetween. This shield current is amplified by feedback amplifier 46 and used to control high voltage power supply 34 so as to adjust the electrical bias of shield 28. This, in turn, suitably regulates the charge applied by corona generating device 26 on photoconductive surface 12. In this way, the charge on photoconductive surface 12 is regulated.

It is clear that corona generating device 36 is the key to improved voltage uniformity. Voltages on photoconductive surface 12 are regulated to be at the same potential as that of shield 38. In order to obtain this, a feedback circuit is employed which monitors the current flowing through shield 38 and adjusts the voltage applied to shield 38 of corona generating device 26. For example, if the potential of photoconductive surface 12, after being charged by corona generating device 26, is lower than the voltage of shield 38, a negative current will flow from shield 38 to photoconductive surface 12. This current is amplified by feedback amplifier 46 and fed back to power supply 34 so as to increase the voltage of shield 28. Similarly, if the voltage of photoconductive surface 12, after being charged by corona generating device 26, is higher than the voltage of shield 38, a decrease in the voltage of shield 28 will occur. The system is in equilibrium when the net voltage of the photoconductive surface 12 under corona generating device 36 is equal to the voltage of shield 38. This produces no current flow to shield 38. Areas of the photoconductive surface having nonuniform voltages cause current flow to and from shield 38. If the voltage of the photoconductive surface is equal to the voltage of shield 38, no current will flow. If, however, an area of photoconductive surface 12 has a different voltage than the voltage of shield 38, current will flow until the voltage of photoconductive surface 12 is equal to the voltage of shield 38. This leveling of voltage nonuniformities improves copy quality.

Power supply 44 regulates the voltage of shield 38. Infrared densitometer 68 detects the density of the developed test areas and produces an electrical output signal indicative thereof. In addition, an electrical output signal is periodically generated by infrared densitometer 68 corresponding to the bare photoconductive surface. These signals are conveyed to controller 98 through suitable conversion circuitry 100. Controller 98 generates an electrical error signal proportional to the ratio of test mass areas. In response to these signals, controller 98 regulates high voltage power supply 44 through logic interface 102. By way of example, power supply 44 may electrically bias shield 38 to a negative voltage of about −750 volts. Variations in the density of the developed test area are detected by densitometer 68 which, in turn, produces an electrical output signal corresponding to this measured density. This electrical output signal is processed by conversion circuitry 100 and conveyed to controller 98 which generates an error signal to regulate high voltage power supply 44 through logic interface 102. Adjustments to high voltage power supply 44 regulate the potential applied to shield 38 so as to control the charge applied to photoconductive surface 12 by corona generating device 26.

In addition to regulating the charging of the photoconductive surface, infrared densitometer 68 controls the dispensing of toner particles into the developer housing 64. The signal from infrared densitometer 68 is transmitted to controller 98 through conversion circuitry 100. Controller 98 activates motor 66 through logic interface 104. Energization of motor 66 causes toner dispenser 62 to discharge toner particles into developer housing 64.

In this way, during operation of the electrophotographic printing machine, both charge on the photoconductive surface and toner particle concentration within the developer mix are suitably regulated. In particular, the apparatus of the present invention controls the charge on the photoconductive surface by employing a pair of corona generating devices with the second corona generating device detecting the level of charge and regulating the charge applied by the first corona generating device so as to maintain the charge levels on the photoconductive surface at an optimum level.

It is, therefore, apparent that there has been provided, in accordance with the present invention, an apparatus for controlling the charging of a photoconductive surface employed in an electrophotograhic printing machine. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for controlling the charging of a photoconductive surface, including:

first corona generating means for charging a portion of the photoconductive surface to a substantially uniform level; and second corona generating means for further charging the portion of the photoconductive surface charged by said first corona generating means, said second corona generating means detecting the level of charge on the portion of the photoconductive surface charged by said first corona generating means and transmitting a control signal to said first corona generating means to regulate the level that said first corona generating means charges the photoconductive surface.

2. An apparatus according to claim 1, wherein said first corona generating means includes:

a first coronode member;

a first conductive shield member;

first means, coupled to said first coronode member, for applying an alternating voltage thereto; and first means for electrically biasing said first conductive shield member to a constant voltage.

3. An apparatus according to claim 2, wherein said second corona generating means includes:

a second coronode member;

a second conductive shield member;

second means, coupled to said second coronode member, for applying an alternating voltage thereto; and second means for electrically biasing said second conductive shield member to a constant voltage.

4. An apparatus according to claim 3, wherein said second corona generating means includes means, coupled to said second conductive shield member and said first electrical biasing means, for generating the control signal regulating the level of the constant voltage on said first conductive shield in response to the detected current flowing between said second conductive shield member and the photoconductive surface.

5. An apparatus according to claim 4, further including means, coupled to said second electrical biasing means, for adjusting the level of the constant voltage applied to said second conductive shield member.

6. An electrophotograhic printing machine of the type in which the charging of a photoconductive surface is controlled, wherein the improvement includes:

first corona generating means for charging a portion of the photoconductive surface to a substantially uniform level; and second corona generating means for further charging the portion of the photoconductive surface charged by said first corona generating means, said second corona generating means detecting the level of charge on the portion of the photoconductive surface charged by said first corona generating means and transmitting a control signal to said first corona generating means to regulate the level that said first corona generating means charges the photoconductive surface.

7. A printing machine according to claim 6, wherein said first corona generating means includes:

a first coronode member;

a first conductive shield member;

first means, coupled to said first coronode member, for applying an alternating voltage thereto; and first means for electrically biasing said first conductive shield member to a constant voltage.

8. A printing machine according to claim 7, wherein said second corona generating means includes:

a second coronode member;

a second conductive shield member;

second means, coupled to said second coronode member, for applying an alternating voltage thereto; and second means for electrically biasing said second conductive shield member to a constant voltage.

9. A printing machine according to claim 8, wherein said second corona generating means includes means, coupled to said second conductive shield member and said first electrical biasing means, for generating the control signal regulating the level of the constant voltage on said first conductive shield in response to the detected current flowing between said second conductive shield member and the photoconductive surface.

10. A printing machine according to claim 9, further including means, coupled to said second electrical biasing means, for adjusting the level of the constant voltage applied to said second conductive shield member.

11. A printing machine according to claim 10, further including means for forming a sample patch of marking particles on the photoconductive surface.

12. A printing machine according to claim 11, wherein said adjusting means includes:

means for sensing the density of the particles of the sample patch and generating an output signal indicative thereof; and means, responsive to the output signal from said sensing means, for regulating the level of the constant voltage applied to said second conductive shield member.

* * * * *